US005632295A

United States Patent [19]

Smårs

[11] Patent Number: 5,632,295

[45] Date of Patent: May 27, 1997

[54] METHOD AND AN APPARATUS FOR ADDING A MELODORANT TO A CONSUMER GAS

[75] Inventor: Erik Smårs, Rimbo, Sweden

[73] Assignee: AGA Aktiebolag, Lidingo, Sweden

[21] Appl. No.: 351,352

[22] PCT Filed: Jun. 16, 1992

[86] PCT No.: PCT/SE92/00432

§ 371 Date: Dec. 8, 1994

§ 102(e) Date: Dec. 8, 1994

[87] PCT Pub. No.: WO93/25638

PCT Pub. Date: Dec. 23, 1993

[51] Int. Cl.[6] ..... C10J 1/28

[52] U.S. Cl. ..... 137/3; 48/195; 137/9; 137/98

[58] Field of Search ..... 137/9, 101.25, 137/98, 3; 48/195

[56] References Cited

U.S. PATENT DOCUMENTS

| | | | |
|---|---|---|---|
| 2,166,370 | 7/1939 | Putnam et al. | 48/195 |
| 2,175,526 | 10/1939 | Hutchison et al. | 48/195 X |
| 2,180,584 | 11/1939 | Green et al. | 48/195 X |
| 3,939,858 | 2/1976 | LeMay | 48/195 X |
| 4,320,775 | 3/1982 | Stirling et al. | 137/98 X |
| 4,611,294 | 9/1986 | Stanfill | 137/3 |
| 5,406,970 | 4/1995 | Marshall et al. | 137/101.25 |

FOREIGN PATENT DOCUMENTS

| | | |
|---|---|---|
| 0 533 670 | 3/1993 | European Pat. Off. . |
| 78172 | 6/1989 | Finland . |
| 78173 | 6/1989 | Finland . |
| 1 185 330 | 1/1963 | Germany . |
| 2 259 314 | 12/1972 | Germany . |
| 23 47 906 | 9/1973 | Germany . |
| 23 37 782 | 2/1975 | Germany . |
| WO90/06170 | 6/1990 | WIPO . |
| WO91/17817 | 11/1991 | WIPO . |

OTHER PUBLICATIONS

Synonym fur Sicherheit, *Gas Erdgas,* Feb. 1970, pp. 159–166.

*Primary Examiner*—Stephen M. Hepperle
*Attorney, Agent, or Firm*—Calfee, Halter & Griswold

[57] ABSTRACT

An arrangement for adding an odorant to a consumer gas which is distributed to a consumer site, in order to indicate to people in the vicinity of the risk of fire, explosion, poisoning, suffocation or some other danger, should consumer gas leak into the surrounding atmosphere. The odorant is dissolved in a condensed vehicle gas in a pressure vessel (3), to obtain a solution, master gas, which includes a liquid phase (6) and a gas phase (7). The consumer gas is diluted with an adapted quantity of the liquid phase of the master gas, which is vaporized prior to being mixed with the consumer gas. To this end, the arrangement includes means (18) for correcting the relationship between the two gas flows during the dilution process with respect to the increase in the concentration of odorant in the liquid phase (6) of the master gas that results from the decreasing relationship between the quantity of liquid gas and gas phase (7) in the pressure vessel. This provides for extremely accurate metering of the master gas. The invention also relates to a method of adding an odorant to a consumer gas.

23 Claims, 3 Drawing Sheets

METHOD AND AN APPARATUS FOR ADDING A MELODORANT TO A CONSUMER GAS

FIELD OF INVENTION

The present invention relates to a method of adding an odorant to a consumer gas which is distributed to a consumer site so as to draw to the attention of people in the vicinity of the risk of fire, explosion, poisoning, suffocation or some other danger should the consumer gas escape to the surrounding atmosphere. In the event of a gas escape, the odorant, which is in a concentrated form, preferably an organic sulphur compound, is dissolved in a condensed vehicle gas contained in a pressure vessel, for instance carbon dioxide, propane or butane, so as to form a solution, a master gas, which includes a liquid phase and a gas phase. The desired odorant concentration of the consumer gas is then achieved by diluting the odorant with an adapted quantity of the liquid phase of the master gas, which is vaporized prior to being mixed with the consumer gas. The amount of master gas added is determined by the flow rate of master gas and the odorant concentration of said master gas and the flow rate of the consumer gas. The invention also relates to an arrangement for use when carrying out the method.

BACKGROUND OF THE INVENTION

The concept of adding odorants to consumer gases in accordance with the aforegoing, so as to indicate the leakage of poisonous or explosive gases for instance, has long been known to the art. One example of gases which may be odorized in this way is oxygen, which if leaking to the surroundings can result in extremely serious accidents caused by fire or explosion. Other examples include combustible gases, such as natural gas, propane, butane, town gas, etc., which can also cause serious accidents in the form of fire and explosions. Since the majority of odorous additives, such as tetrahydro thiophene, butyl mercaptan, dimethyl sulphide, etc., are readily ignitable substances which require the application of special techniques when added to oxygen for instance.

Finish Patent Application 870146 discloses a method of adding an odorant to oxygen, in which a concentrated gas, so-called master gas, is produced in a separate chamber or space by adding to pure oxygen gas an odorant in a concentration of 1,000–10,000 ppm. This concentrated master gas is added to the consumer gas in a separate chamber, or space, in an amount such that the odorant will be present in the consumer gas in a concentration of 5–50 ppm.

When the master gas contains solely oxygen and odorant, for instance dimethyl sulphide, problems can occur, however, when filling the master gas containers. For instance, when filling the containers, it is impossible to avoid passing through a concentration range in which the mixture is combustible, at least in a part of the container. There is thus a risk of the mixture igniting and exploding.

One method of avoiding this risk is disclosed in the Finnish Patent Application No. 872278. This application describes a method of producing a concentrated master gas comprising oxygen and an odorant, such as dimethyl sulphide. According to this method, the master gas container is first filled with a mixture of dimethyl sulphide and nitrogen or helium gas. The concentration of dimethyl sulphide lies within a range of 0.5–2.5%. Pure oxygen gas is then added until the desired working pressure in the container is reached, for instance a pressure of 200 bars.

One drawback with the master gas produced in accordance with the aforedescribed methods, however, is that the master gas must not be subjected to temperatures which are so low as to cause the odorant to condense, for instance during transportation and storage. Once being condensed, it takes a very long time for the dimethyl sulphide to return to its gaseous state.

Prior publications DE-B-1185330 and WO 91/17817 describes methods which reduce this problem in that the odorant is dissolved in a gas which exists in liquid phase at room temperature and under pressure. Propane, butane, carbon dioxide, sulphur hexafluoride and nitrous oxide have been given as examples of suitable gases in this respect. These gases also fulfil the requirement of not having a negative influence, in the majority of cases, on the process in which the odorized gas is used.

It is suggested in prior publication DE-B-1 185 330 that the odorized master gas is taken from the pressure vessel and delivered to the consumer gas conduit via a fine setting valve which can normally be maintained at a predetermined setting during the consumption of all of the master gas. However, in the case of large variations in the flow rate of the consumer gas, it is said that the flow rate of the master gas can be controlled in response to such variations.

In practice, however, this and other known solutions do not provide the odorant metering accuracy that is desired. This is because the odorant vehicle gas has a much higher vapor pressure than the liquid odorant. Thus, the gas volume present above the liquid phase of the master gas in the pressure vessel will consist essentially of vaporized vehicle gas and only a very small part of vaporized odorant liquid. As the volume of the liquid phase in the pressure vessel diminishes when master gas is delivered to the consumer gas, the increasing volume of vaporized vehicle gas in the pressure vessel will result in an increase in the relative concentration of the liquid odorant in the liquid phase in the pressure vessel.

OBJECTS OF THE INVENTION

A main object of the present invention is therefore to propose a method which will solve the problem of a volume-dependent concentration of odorant in the master gas.

Another object is to provide an arrangement which can be used when applying the inventive method in order to eliminate the effect of the volume-dependent concentration of odorant in the master gas.

DISCLOSURE OF THE INVENTION

The aforesaid objects are achieved in accordance with the present invention by adjusting the amounts in which the master gas is metered to the consumer gas in accordance with the relationship between liquid phase and gas phase in the pressure vessel.

The significant characteristic feature of a method of the kind defined in the first paragraph of this document is therewith to correct the relationship between the flows of master gas and consumer gas during the dilution process while taking into account the increase in the concentration of odorant in the liquid phase of the master gas that results from the reducing relationship between the amount of liquid phase and the amount of gas phase in the pressure vessel. This procedure eliminates the aforesaid problem encountered with earlier known solutions.

The amount of master gas remaining in the pressure vessel will preferably be determined continuously by continuous integration of the master gas flow from the pressure vessel and by subtracting the value obtained from the amount of master gas that was initially present, and then correcting the relationship between the two gas flows continuously during the dilution process on the basis of this determination. This will result in highly accurate metering of the amount of odorant mixed in the consumer gas.

According to one preferred embodiment, the accuracy at which the odorant is metered can be further improved by determining the temperature of the master gas in the pressure vessel and also correcting the relationship between the two gas flows on the basis of detected temperature changes. Other characteristic features of the inventive method and of an inventive arrangement for use when practicing said method will be evident from the following claims.

The invention will now be described in more detail with reference to an exemplifying embodiment of the invention and also with reference to the accompanying drawings.

DESCRIPTION OF A PREFERRED EMBODIMENT OF THE INVENTION

Figure 1:
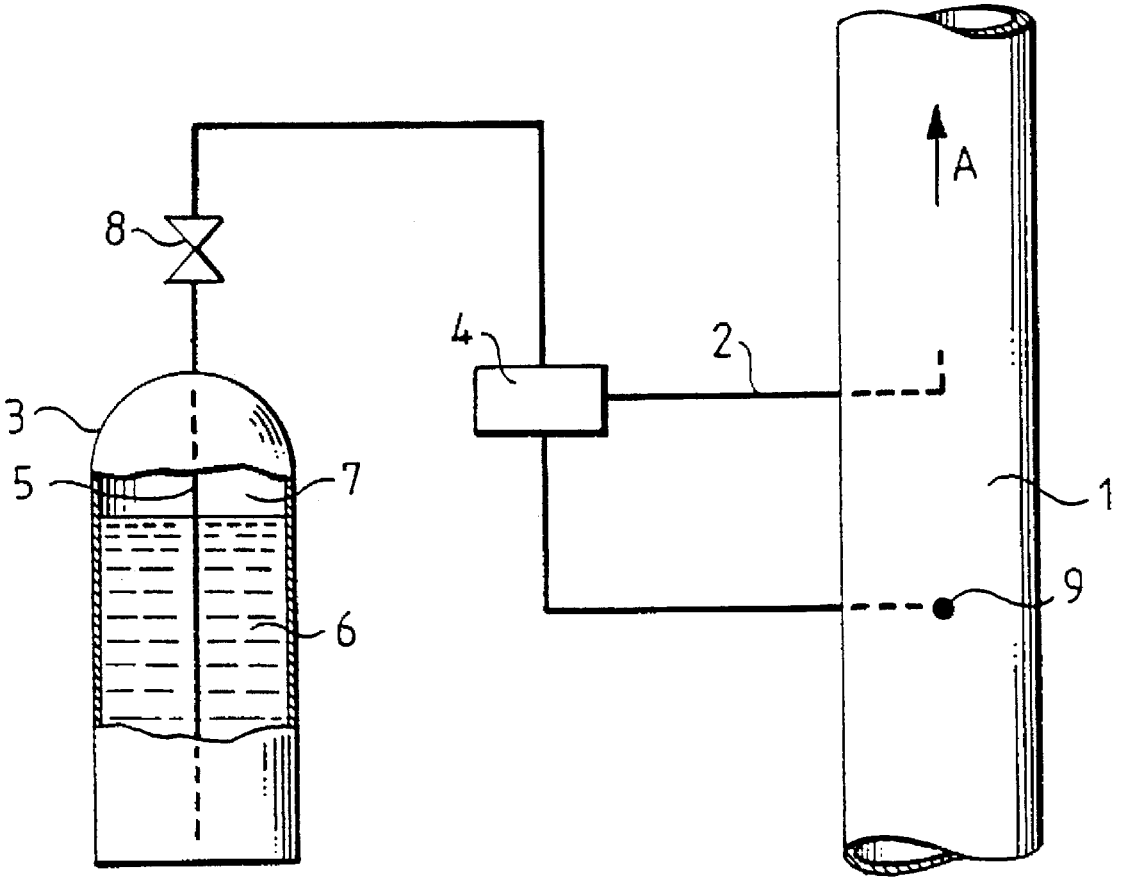
FIG. 1 is a schematic illustration of the principles according to which an inventive arrangement operates.

The arrangement illustrated in FIG. 1 comprises a conduit 1 for consumer gas, for instance oxygen, which flows in the direction of the arrow A and to which an odorant shall be added. The odorant is added through a conduit 2 which delivers master gas from a pressure vessel 3, through a control valve 4. The master gas may consist of a mixture of an organic sulphur compound, such as dimethyl sulphide, DMS, and carbon dioxide. The master gas is taken from the liquid phase 6 in the pressure vessel 3 by means of an immersion pipe 5, said master gas being driven from the vessel through a closing valve 8, through the agency of the pressure exerted by the vaporized gas volume 7. The control valve 4 is controlled, among other things, in response to the flow of consumer gas through the conduit 1, this flow being determined with the aid of a flowmeter 9.

In the above example, the vapor pressure of carbon dioxide is 57 bars at 20° C., whereas the vapor pressure of the odorant liquid is much lower, considerably lower than 0.5 bar at 20° C. in the case of DMS. The gaseous atmosphere 7 above the liquid phase 6 in the pressure vessel 3 will therefore mainly consist of vaporized carbon dioxide. Since the amount of liquid phase 6 decreases as it is supplied to the conduit 1, the amount of vaporized gas above the liquid phase will increase accordingly. Since it is primarily carbon dioxide that is vaporized, as described above, the relative concentration of the odorant in the liquid phase 6 will increase.

The successive change in the relative concentration of odorant in the liquid phase can be determined quantitatively. When designating the initial odorant concentration in the liquid phase of a full pressure vessel $C_{10}$ and when using the designation $C_1$ for the odorant concentration subsequent to a given relative consumption $m_x/m_{10}$, where $m_x$ is the amount of liquid phase consumed and $m_{10}$ is the amount initially present, the change in relative concentration in the liquid phase can be described with the aid of the following equation:

$$\frac{C_1}{C_{10}} = \left(1 - \frac{m_x}{(1-k)m_{10}}\right)^{-k}$$

In this equation, $k=\rho_g/\rho_1$, where $\rho_1$ is the density of the liquid phase and $\rho_g$ is the density of the gas phase. The calculated values for $CO_2$ and DMS are given in a diagrammatic form in FIG. 2. This diagram shows the relative concentration of the odorant in the liquid phase as a function of the amount of liquid phase that has been consumed from an initially full pressure vessel, i.e. $m_x=0$, wherein $m_x/m_1=0$ until 90% of the liquid phase has been consumed, when $m_x/m_{10}=0.9$. The concentration is shown at given temperatures within the range of 0° C. to 28° C.

It will be seen from the diagram, for instance, that at 20° C. and when 70% of the liquid phase has been consumed, the odorant concentration of the liquid phase will be almost twice its original concentration. At a temperature of 26° C., this state is reached when hardly 55% of the liquid phase has been consumed. If this is not corrected, there will automatically occur a corresponding, unintentional increase in the level of odorant in the consumer gas. This is a serious drawback with earlier proposed methods and excludes the use of such methods in applications which require a constant odorant level within a very narrow range of concentration.

Figure 3:
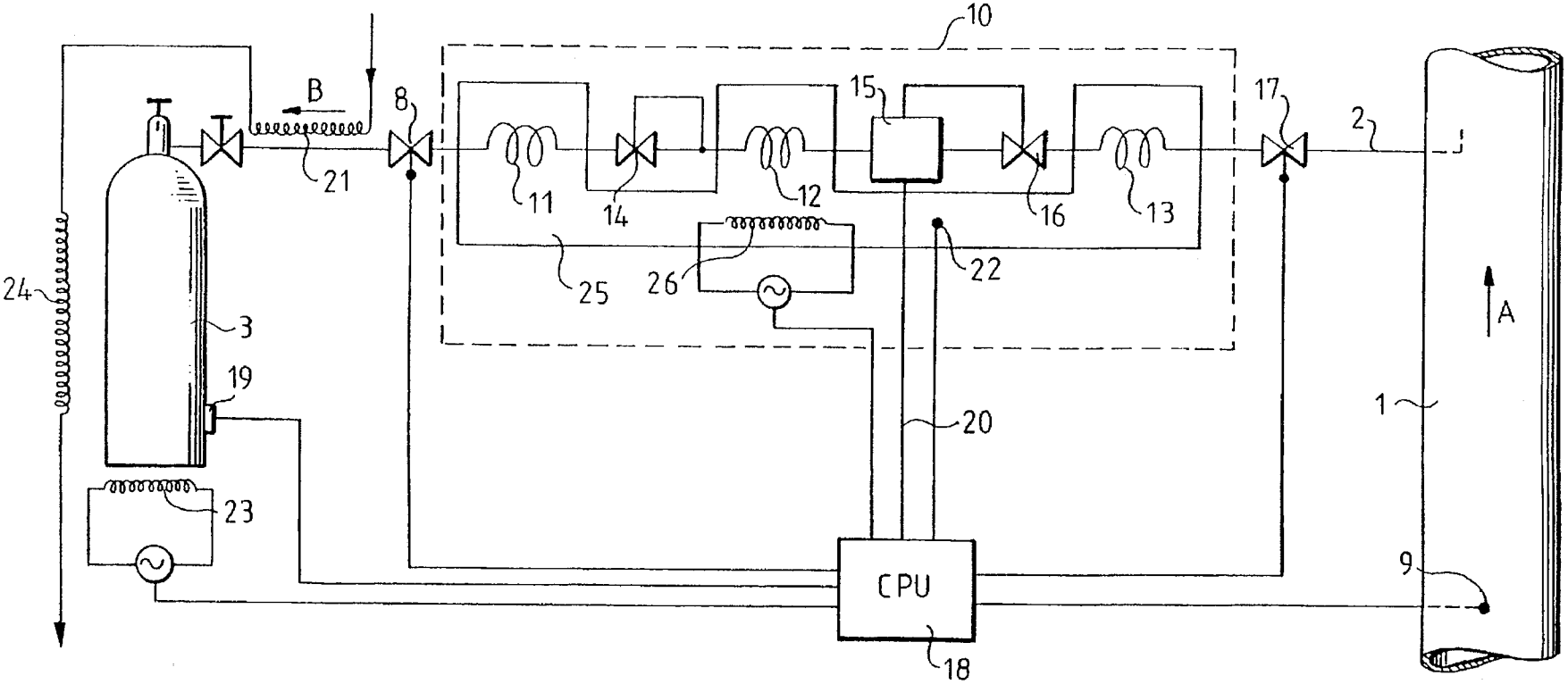
FIG. 3 illustrates schematically the principles according to which one embodiment of an inventive arrangement operates.

With the intention of solving this problem, there is proposed in accordance with the invention an arrangement for adding an odorant to a consumer gas, this arrangement being illustrated schematically in FIG. 3. As earlier mentioned, this arrangement includes a conduit 1 for conducting consumer gas which flows in the direction of the arrow A, wherein the gas to which the odorant has been added is delivered from the pressure vessel 3 through the conduit 2. The flow of consumer gas is determined by means of the flowmeter 9. In the aforegoing, it has been assumed that the master gas is comprised of a mixture of $CO_2$ and DMS. The master gas is forced out from the pressure vessel 3 in a liquid state, through the agency of the pressure exerted by vaporized carbon dioxide, and through the closure valve 8 to a vaporizing and controlling unit 10, which includes three heating loops 11, 12, 13 through which hot or warm water flows, a pressure regulating valve 14 and a mass flowmeter 15 which is coupled with a control valve 16 of a so-called mass flow control device which measures and, at the same time, adjusts the flow of master gas. A further closure valve 17 is coupled in the conduit 2, outwardly of the unit 10.

The arrangement also includes a central processor unit 18, CPU. This unit contains information concerning the desired odorant admixture, i.e. the concentration of odorant in the consumer gas. The flowmeter 9 provides the central unit with information concerning the flow of consumer gas, while information concerning the temperature of the master gas in the pressure vessel 3 is delivered to the central unit from a temperature sensor 19.

The central unit 18 has also been provided with information concerning the initial amount of odorant in the master gas and the instant odorant concentration of the master gas in the pressure vessel 3 and receives, through a conductor 20, information concerning the momentary flow of master gas, which is integrated over the time taken to determine consumption. The central processing unit will thus always contain information concerning the quantity of master gas that remains in the pressure vessel at any given moment in time.

Thus, when applying the above equation, the central unit 18 is able to determine the relative change in concentration and therewith also to calculate the instant concentration of odorant in the liquid phase of the master gas. The central unit controls the delivery of master gas to the consumer gas on the basis of this determination and in accordance with the flow of consumer gas, with the aid of the control valve 16. This enables odorant to be metered to the consumer gas very accurately.

Figure 2:
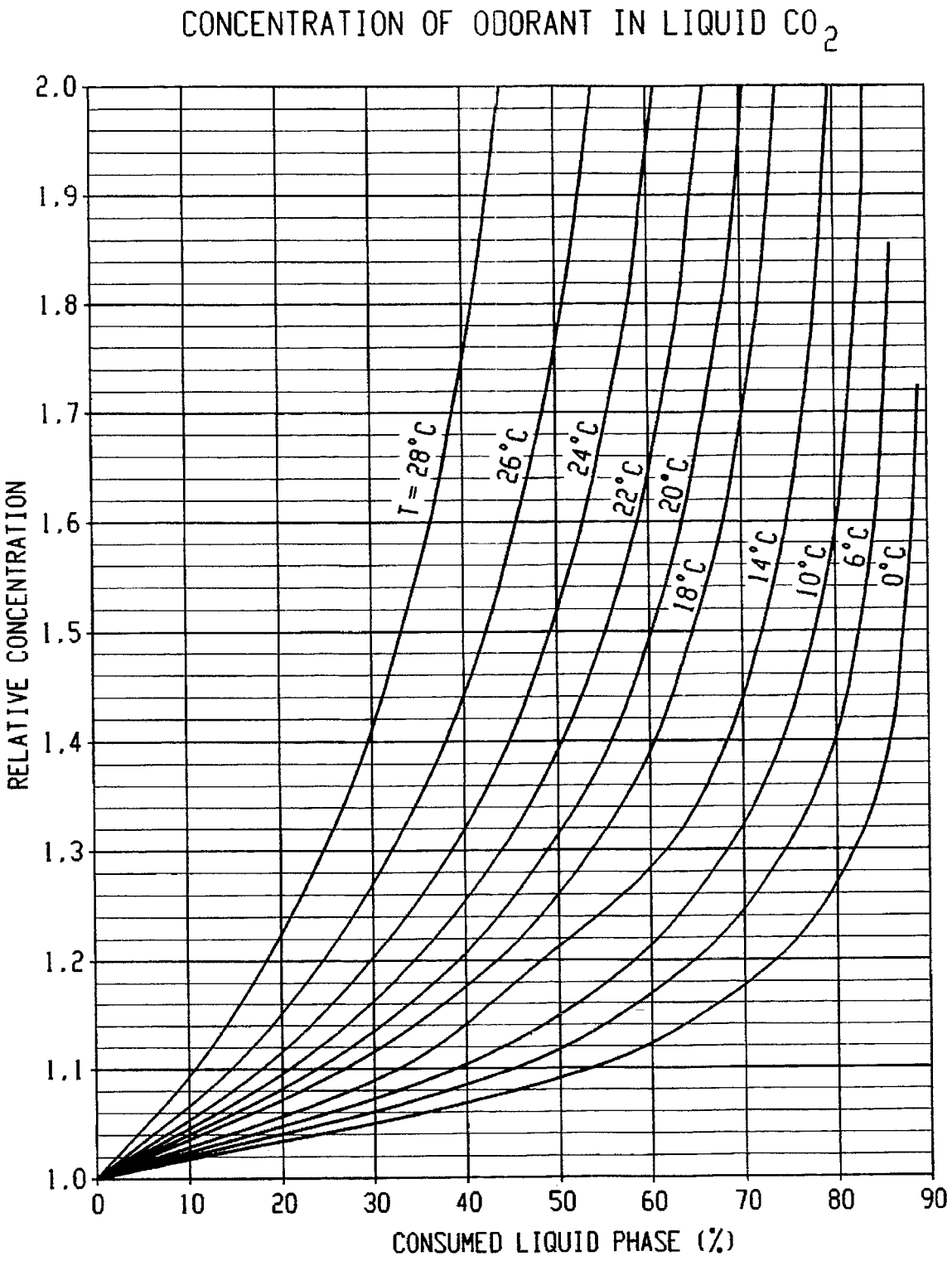
FIG. 2 is a diagram which illustrates the relative concentration of odorant in the liquid phase of the master gas as a function of the amount of liquid phase taken from the pressure vessel at different temperatures.

The FIG. 2 diagram illustrates changes in concentration which occur as a result of vaporization or condensation processes in a two-phase system which includes components of mutually different properties. Such effects are not limited to the pressure vessel in an odorizing arrangement of the aforedescribed kind, but can also occur at other places in the system where temperature or pressure change.

The presence of two phases in one stream results in different rates of flow, which may give rise to variations in the metering process. This problem can be eliminated in accordance with the present invention, by heating or cooling the system at given points therein, so as to obtain thermal gradients which prevent undesirable condensation or vaporization. In the case of the FIG. 3 arrangement, the liquid master gas is accordingly heated and vaporized in the heating loop 11 prior to entering the pressure regulator 14 and also downstream of said regulator, since in the case of $CO_2$ reduction to the working pressure required in the regulator, about 15 bars, requires expansion of the master gas, with the accompanying risk of condensation as a result of the decrease in temperature that occurs herewith. Consequently, the master gas is again heated by the heating coil 12 prior to being delivered to the flowmeter 15.

A final master gas expansion phase takes place downstream of the control valve 16 and a fubak heating coil 13 ensures that no condensation will occur at this location, which could cause changes in the composition of the master gas and subsequent variations in the metering process. The three heating coils are mutually connected in series and hot water is conveniently passed through the coils. When the master gas includes $CO_2$, this water may have a temperature of 50° C., for instance. This enables the remainder of the arrangement to be maintained at a lower temperature level, so as to ensure that the master gas will definitely arrive at the vaporizing unit 10 in a liquid state. In accordance with the invention, the coldest part of the inventive arrangement is the input to the vaporizer.

The gas conduit between the gas bottle 3 and the vaporizer input is cooled by a cooling element 21 which is placed adjacent said conduit and through-passed by cold water. The requisite temperature gradient between the vaporizer input and the flask temperature is therewith achieved by passing the cooling water in counterflow to the direction of master gas flow, arrow B.

The temperature of the pressure vessel 3, about 18° C. in the case of $CO_2$, is also related to the temperature of the vaporizing unit 10, this temperature being sensed by a sensor 22, in accordance with the invention. In order to maintain a constant temperature difference, the central unit 18 controls the temperature of the pressure vessel 3 through the combined effect of the heating coil 23 and the cooling coil 24, among other things in dependence on ambient temperature.

Although the invention has been described with reference to an exemplifying embodiment thereof in which there is used a master gas which includes carbon dioxide and dimethyl sulphide, it will be understood that the same conditions also apply to other vehicle gases, such as propane, butane, sulphur hexafluoride and dinitrogen oxide, etc., wherein the odorant used may alternatively be, for instance, tetrahydro thiophene, methyl mercaptan, ethyl mercaptan, propyl mercaptan or butyl mercaptan, and dimethyl sulphide, diethyl sulphide and methylethyl sulphide. The odorant concentration of the master gas is conveniently 0.5–10 mol %. The master gas can be delivered to the consumer gas in an amount to obtain a consumer gas odorant concentration within the range of 1–50 ppm, preferably 1–20 ppm.

I claim:

1. A process for regulating the amount of a master gas supplied to a flowing consumer gas, said master gas being contained in a pressure vessel and comprising a malodorant and a vehicle gas, said master gas being contained in said pressure vessel in both the liquid phase and the vapor phase, said process comprising correcting the relationship between the flow of said consumer gas and the flow of said master gas supplied to said consumer gas in response to the increase of concentration of the malodorant in the liquid phase of the master gas that results from the decreasing relationship between the amount of liquid phase and gas phase in the pressure vessel.

2. A method according to claim 1, wherein the amount of master gas remaining in the pressure vessel is determined by continuously integrating the flow of master gas from the vessel and subtracting the value obtained from the initial quantity of master gas; said process further comprising continuously correcting the relationship between the flows of said consumer gas and said master gas during the dilution process on the basis of this determination.

3. A method according to claim 2 comprising determining the temperature of the master gas in the pressure vessel, and correcting the relationship between the flows of said consumer gas and said master gas also in response to the temperature changes detected.

4. A method according to claim 3 comprising maintaining such temperature gradients in the system by heating or cooling said system in a manner to prevent undesirable condensation or vaporization processes that are able to influence the accuracy of the dilution process.

5. Apparatus for regulating the amount of master gas being supplied to a flowing consumer gas, said master gas comprising a malodorant gas and a vehicle gas, said master gas being contained in a pressure vessel in both the liquid phase and the vapor phase, said apparatus comprising a controller correcting the relationship between the flow of said consumer gas and the amount of said master gas being supplied thereto in response to the increase in the concentration of malodorant in the liquid phase of the master gas that results from the decreasing relationship between the amount of liquid phase and gas phase in the pressure vessel.

6. A method according to claim 2, comprising maintaining such temperature gradients in the system by heating or cooling said system in a manner to prevent undesirable condensation or vaporization processes that are able to influence the accuracy of the dilution process.

7. A method according to claim 1, comprising maintaining such temperature gradients in the system by heating or cooling said system in a manner to prevent undesirable condensation or vaporization processes that are able to influence the accuracy of the dilution process.

8. A method according to claim 1, comprising determining the temperature of the master gas in the pressure vessel, and correcting the relationship between the flows of said consumer gas and said master gas also in response to the temperature changes detected.

9. The apparatus of claim 8, wherein said controller continuously determines the concentration of malodorant in the liquid phase by determining the amount of master gas remaining in said pressure vessel.

10. The apparatus of claim 9, wherein said controller determines the amount of master gas remaining in said pressure vessel by continuously (1) integrating the flow of master gas from said pressure vessel, and (2) subtracting the value so obtained from the initial amount of master gas in said pressure vessel.

11. The apparatus of claim 2, wherein said controller regulates the flow of said master gas also in response to the temperature of master gas in said pressure vessel.

12. The apparatus of claim 1, further comprising a vaporizer for vaporizing master gas recovered from said pressure vessel in the liquid phase, a conduit connecting said pressure vessel and said vaporizer and a heater for maintaining the master gas in said pressure vessel at an essentially constant temperature above the temperature of master gas in said conduit.

13. The apparatus of claim 1, wherein said vaporizer includes a pressure reducer connected to said conduit, a control valve downstream of said pressure reducer for controlling the flow of master gas to said consumer gas, and a heating system for heating said master gas in said vaporizer to prevent undesirable condensation of malodorant therein.

14. The apparatus of claim 13, wherein said controller regulates the flow of said master gas also in response to the temperature of master gas in said pressure vessel.

15. The apparatus of claim 11, wherein said vaporizer includes a pressure reducer connected to said conduit, a control valve downstream of said pressure reducer for controlling the flow of master gas to said consumer gas, and a heating system for heating said master gas in said vaporizer to prevent undesirable condensation of malodorant therein.

16. The apparatus of claim 10, wherein said vaporizer includes a pressure reducer connected to said conduit, a control valve downstream of said pressure reducer for controlling the flow of master gas to said consumer gas, and a heating system for heating said master gas in said vaporizer to prevent undesirable condensation of malodorant therein.

17. The apparatus of claim 16, wherein said vaporizer includes a pressure reducer connected to said conduit, a control valve downstream of said pressure reducer for controlling the flow of master gas to said consumer gas, and a heating system for heating said master gas in said vaporizer to prevent undesirable condensation of malodorant therein.

18. The apparatus of claim 8, wherein said vaporizer includes a pressure reducer connected to said conduit, a control valve downstream of said pressure reducer for controlling the flow of master gas to said consumer gas, and a heating system for heating said master gas in said vaporizer to prevent undesirable condensation of malodorant therein.

19. The apparatus of claim 9, wherein said controller regulates the flow of said master gas also in response to the temperature of master gas in said pressure vessel.

20. The apparatus of claim 8, wherein said controller regulates the flow of said master gas also in response to the temperature of master gas in said pressure vessel.

21. The apparatus of claim 15, wherein said controller determines the amount of master gas remaining in said pressure vessel by continuously (1) integrating the flow of master gas from said pressure vessel, and (2) subtracting the value so obtained from the initial amount of master gas in said pressure vessel.

22. A process for regulating the amount of a master gas supplied to a flowing consumer gas, said master gas being contained in a pressure vessel and comprising a malodorant and a vehicle gas, said master gas being contained in said pressure vessel in both the liquid phase and the vapor phase, said process comprising correcting the relationship between the flow of said consumer gas and the flow of said master gas supplied to said consumer gas in response to the increase in concentration of the malodorant in the liquid phase of the master gas that results from the decrease in the amount of liquid phase in the pressure vessel.

23. Apparatus for regulating the amount of master gas being supplied to a flowing consumer gas, said master gas comprising a malodorant gas and a vehicle gas, said master gas being contained in a pressure vessel in both the liquid phase and the vapor phase, said apparatus comprising a controller correcting the relationship between the flow of said consumer gas and the amount of said master gas being supplied thereto in response to the increase in the concentration of malodorant in the liquid phase of the master gas that results from the decrease in the amount of liquid phase in the pressure vessel.

* * * * *